US008146743B2

(12) United States Patent
Stonehouse

(10) Patent No.: US 8,146,743 B2
(45) Date of Patent: Apr. 3, 2012

(54) CLOSURE FOR CLAMSHELL PACKAGE

(75) Inventor: Donald B. Stonehouse, Dayton, OH (US)

(73) Assignee: Burrows Paper Corporation, Little Falls, NY (US)

( * ) Notice: Subject to any disclaimer, the term of this patent is extended or adjusted under 35 U.S.C. 154(b) by 161 days.

(21) Appl. No.: 12/420,590

(22) Filed: Apr. 8, 2009

(65) Prior Publication Data

US 2010/0258615 A1 Oct. 14, 2010

(51) Int. Cl.
*G09F 19/02* (2006.01)
*B65D 5/66* (2006.01)

(52) U.S. Cl. ..... 206/459.1; 229/114; 229/146; 229/148; 229/902

(58) Field of Classification Search ..... 229/114, 229/120.15, 125.29, 146, 148, 902, 906
See application file for complete search history.

(56) References Cited

U.S. PATENT DOCUMENTS

| | | | | | |
|---|---|---|---|---|---|
| 2,623,684 | A * | 12/1952 | Collura | 229/117.07 |
| 2,922,565 | A * | 1/1960 | Roderick et al. | 229/145 |
| 2,982,465 | A * | 5/1961 | Fallert | 229/117.07 |
| 3,410,475 | A * | 11/1968 | Wagner | 229/119 |
| 4,570,845 | A * | 2/1986 | Hall | 229/146 |
| 4,877,178 | A | 10/1989 | Eisman | |
| 4,964,561 | A | 10/1990 | Whelan | |
| 5,037,026 | A * | 8/1991 | Hanko | 229/125.29 |
| 5,044,549 | A | 9/1991 | Beales | |
| 5,058,803 | A | 10/1991 | Gulliver | |
| 5,188,284 | A * | 2/1993 | Eisman | 229/110 |
| 5,205,476 | A | 4/1993 | Sorenson | |
| 5,388,758 | A | 2/1995 | Scovell | |
| 5,443,202 | A | 8/1995 | Jorgensen-Beck et al. | |
| 5,718,368 | A | 2/1998 | Rench et al. | |
| 5,826,781 | A | 10/1998 | Jensen | |
| 5,909,840 | A * | 6/1999 | Schultheiss | 229/120.17 |
| 6,041,997 | A | 3/2000 | Jensen | |
| 6,283,364 | B1 | 9/2001 | Gray, Sr. | |
| 6,474,539 | B1 * | 11/2002 | Van Der Horst | 229/120.14 |
| 7,232,054 | B2 | 6/2007 | Yocum | |
| 7,431,198 | B2 | 10/2008 | D'Amato | |
| 2007/0012754 | A1 * | 1/2007 | Stier | 229/108 |
| 2008/0110966 | A1 | 5/2008 | Yocum | |

* cited by examiner

*Primary Examiner* — Gary Elkins
(74) *Attorney, Agent, or Firm* — George R. McGuire; David B. Woycechowsky; Bond Schoeneck & King

(57) ABSTRACT

A clamshell style paper board container including a tab-and-slot closure to openably secured the top and bottom halves of the clamshell in a closed position. Unlike conventional designs where the tabs in the bottom half extend from the side walls toward the front of the container, the tabs in the bottom half extend from the front wall toward the sides of the container. Also, a punch in device that can be used to provide a steam hole and/or an indicator of package contents where the punch in device include four generally parallel fold lines extending between two generally parallel perforations. When the punch-in device is punched in by a user, one of the fold lines is moved from: (i) a folded state at a location at a corner between two walls of the container to; (ii) an unfolded state at a location displaced from the corned toward the interior of the container.

1 Claim, 5 Drawing Sheets

CLOSURE FOR CLAMSHELL PACKAGE

BACKGROUND OF THE INVENTION

1. Field of the Invention

The present invention relates to clamshell packages and more particularly to closures for clamshell packages of the type generally used to hold food products.

2. Description of the Related Art

Clamshell packages of the type generally used to store food are conventional. More specifically, clamshell containers made of cardboard (see DEFINITIONS section) and having tab-and-slot closures for securing the hinged lid in a closed position are conventional. For example, U.S. Pat. No. 5,205,476 ("Sorenson") discloses a paperboard clamshell carton including a tab-and-slot closure for openably securing the lid down in the closed position. One of the drawings of Sorenson is reproduced as FIG. 10 of this document. As shown in FIG. 10, the Sorenson carton includes portions 11,12,27,28,29,30,31,52,54. As further shown in FIG. 10, the front panel of the top half of the carton includes two (2) slots or recesses, with the "front" panel being defined as the panel on the side opposite the carton hinge. These slots or recesses respectively engage with tabs that extend from two (2) opposing the side walls of the bottom half of the carton in a direction parallel to the two opposing side walls of the bottom half of the carton. In other words, the tabs in the bottom half extend in the frontwards direction of the Sorenson carton.

It is conventional for paperboard clamshell packages to have punch-in devices that are structures a perforations and fold lines. As two examples, U.S. Pat. No. 5,058,803 ("Gulliver") and U.S. Pat. No. 7,232,054 ("Yocum 1") show punch-in devices in the form of toggle action tabs.

Other publication(s) which may be of interest may include: (i) U.S. Pat. No. 5,718,368 ("Rench"); (ii) U.S. Pat. No. 4,964,561 ("Whelan"); (iii) U.S. Pat. No. 5,443,202 ("Jorgensen-Beck"); (iv) U.S. Pat. No. 6,041,997 ("Jensen 1"); (v) U.S. Pat. No. 6,283,364 ("Gray"); (vi) U.S. Pat. No. 5,388,758 ("Scovell"); (vii) U.S. Pat. No. 5,826,781 ("Jensen 2"); (vii) U.S. Pat. No. 7,431,198 ("D'Amato"); (viii) US patent application 2008/0110966 ("Yocum 2"); (ix) US patent application 2007/0012754 ("Stier"); (x) U.S. Pat. No. 5,044,549 ("Beales"); (xi) U.S. Pat. No. 4,877,178 ("Eisman"); and/or (xii) U.S. Pat. No. 6,041,997 ("Jensen 3").

Description Of the Related Art Section Disclaimer: To the extent that specific publications are discussed above in this Description of the Related Art Section, these discussions should not be taken as an admission that the discussed publications (for example, published patents) are prior art for patent law purposes. For example, some or all of the discussed publications may not be sufficiently early in time, may not reflect subject matter developed early enough in time and/or may not be sufficiently enabling so as to amount to prior art for patent law purposes. To the extent that specific publications are discussed above in this Description of the Related Art Section, they are all hereby incorporated by reference into this document in their respective entirety(ies).

BRIEF SUMMARY OF THE INVENTION

The present invention is directed to a clamshell style paper board container including a tab-and-slot closure to openably secured the top and bottom halves of the clamshell in a closed position. Unlike conventional designs where the tabs in the bottom half extend from the side walls toward the front of the container, the tabs in the bottom half extend from the front wall toward the sides of the container. Also, a punch in device that can be used to provide a steam hole and/or an indicator of package contents where the punch in device include four generally parallel fold lines extending between two generally parallel perforations. When the punch-in device is punched in by a user, one of the fold lines is moved from: (i) a folded state at a location at a corner between two walls of the container to; (ii) an unfolded state at a location displaced from the corned toward the interior of the container.

Various embodiments of the present invention may exhibit one or more of the following objects, features and/or advantages:

(i) clamshell container capable of remaining in the closed position even when its contents (for example, a sandwich) are relatively heavy;

(ii) a clamshell container where the closure is relatively hidden (iii) a clamshell container with improved aesthetics;

(iv) a clamshell container that is easy to open;

(v) a clamshell container that reliably stays closed until being opened; and/or (vi) a punch-in device for a clamshell container that is less expensive, more reliable in content indicating operation, more reliable in steam venting operation, easier to manufacture and/or more aesthetically attractive.

According to one aspect of the present invention, a package includes a top clamshell half portion, a bottom clamshell half portion and a pivoting portion. the pivoting portion mechanically connects (see DEFINITIONS section) the top clamshell half portion to the bottom clamshell half portion so that the top clamshell half portion and the bottom clamshell half portion are rotatable relative to each other between an open position and closed position. The top clamshell half portion defines a front-left corner, front-right corner, a front-left slot in the vicinity of the front-left corner and a front-right slot in the vicinity of the front-right corner. The bottom clamshell half portion defines a front-left corner, front-right corner, a front-left tab extending from the vicinity of the front-left corner and a front-right tab extending from the vicinity of the front-right corner. The front-left tab and the front-left slot are sized and located so that the front-left tab fits into the front-left slot when the package is in the closed position. The front-right tab and the front-right slot are sized and located so that the front-right tab fits into the front-right slot when the package is in the closed position The front-left tab and the front-left slot are sized and located so that the front-left tab is released from the front-left slot when the package is moved from the closed position to the open position. The front-right tab and the front-right slot are sized and located so that the front-left tab is released from the front-left slot when the package is moved from the closed position to the open position. The bottom clamshell half portion includes a bottom front wall. The front-left tab extends from the bottom front wall in a leftwards direction generally along the direction of the bottom front wall. The front-left tab extends from the bottom front wall in a leftwards direction generally along the direction of the bottom front wall.

According to a further aspect of the present invention, a package includes a top clamshell half portion, a bottom clamshell half portion and a pivoting portion. the pivoting portion mechanically connects (see DEFINITIONS section) the top clamshell half portion to the bottom clamshell half portion so that the top clamshell half portion and the bottom clamshell half portion are rotatable relative to each other between an open position and closed position. The top clamshell half portion defines a front-left corner, front-right corner, a front-left slot in the vicinity of the front-left corner and a front-right slot in the vicinity of the front-right corner. The bottom clamshell half portion defines a front-left corner, front-right corner, a front-left tab extending from the vicinity of the front-left corner and a front-right tab extending from the vicinity of the front-right corner. The front-left tab and the front-left slot are sized and located so that the front-left tab fits into the front-left slot when the package is in the closed position. The front-right tab and the front-right slot are sized and located so that the front-right tab fits into the front-right slot when the package is in the closed position The front-left tab and the front-left slot are sized and located so that the front-left tab is released from the front-left slot when the package is moved from the closed position to the open position. The front-right tab and the front-right slot are sized and located so that the front-left tab is released from the front-left slot when the package is moved from the closed position to the open position. The bottom clamshell half portion includes a bottom front wall The bottom front wall, the front-left tab, the front-left slot, the front-right tab and the front left slot are sized and located so the pressure applied to the bottom front wall, in a direction generally perpendicular to the bottom front wall when the package is in the closed position will cause the front-left tab to be released from the front-left lot and will cause the front-right tab to be released from the front-right slot.

According to a further aspect of the present invention, a cardboard package includes a top clamshell half portion, a bottom clamshell half portion and a pivoting portion. The top clamshell half portion includes: a top-rear side wall, a top-left side wall located at an end of the top-rear side wall, a top-right side wall located at an end of the top-rear side wall opposite the top-left side wall, a top-front side wall located between an end of the top-left side wall and an end of the top-right side wall and located opposite the top-rear side wall, and a top-top wall extending between and among the top-rear wall, the top-front wall, the top-left wall and the top-right wall. The bottom clamshell half portion includes: a bottom-rear side wall, a bottom-left side wall located at an end of the bottom-rear side wall and generally aligned with the top-left side wall, a bottom-right side wall located at an end of the bottom-rear side wall opposite the bottom-left side wall and generally aligned with the top-left side wall, a bottom-front side wall located between an end of the bottom-left side wall and an end of the bottom-right side wall and located opposite the bottom-rear side wall, and a bottom-bottom wall extending between and among the bottom-rear wall, the bottom-front wall, the bottom-left wall and the bottom-right wall. The pivoting portion mechanically connects the top-rear side wall to the bottom-rear side wall so that the top clamshell half portion and the bottom clamshell half portion are rotatable relative to each other between an open position and closed position about a rotational axis. The bottom-front side wall includes an upper portion that extends in an upwards direction, away from the bottom-bottom wall beyond the bottom-left side wall and beyond the bottom-right side wall. The upper portion of the bottom-front side wall includes a left tab that extends along the direction of the bottom-front wall in a leftwards direction beyond the bottom-left side wall and a right tab that extends along the direction of the bottom-front wall in a right wards direction beyond the bottom-right side wall.

According to a further aspect of the present invention, a cardboard package includes: a first wall; a second wall located to meet the first wall at a first corner; and a punch-in device. the punch-in device is located in the vicinity of the first corner. The punch-in device includes: a first perforation extending across the first corner and at an angle to the first corner, a second perforation extending across the first corner and at an angle to the first corner, a first fold line generally parallel to the first corner and extending at least from the first perforation to the second perforation, a second fold line generally parallel to the first corner and extending at least from the first perforation to the second perforation, a third fold line generally parallel to the first corner and extending at least from the first perforation to the second perforation, and a fourth fold line generally parallel to the first corner and extending at least from the first perforation to the second perforation.

BRIEF DESCRIPTION OF THE DRAWINGS

The present invention will be more fully understood and appreciated by reading the following Detailed Description in conjunction with the accompanying drawings, in which.

DETAILED DESCRIPTION OF THE INVENTION

Figure 1:
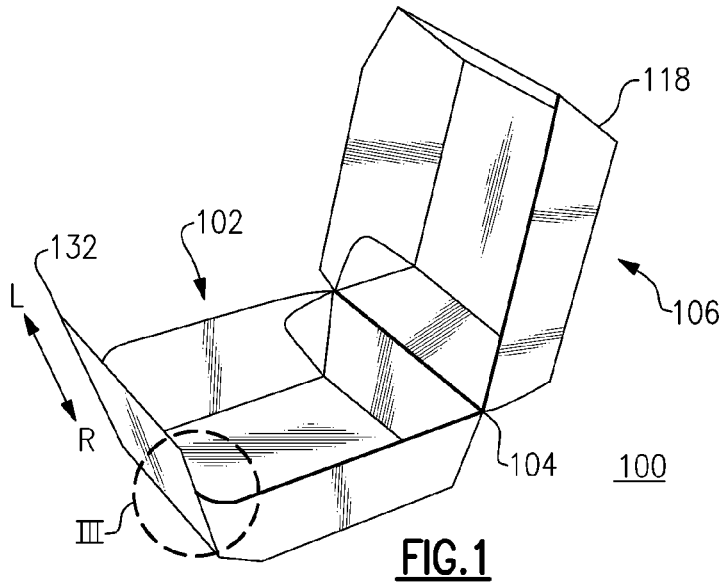
FIG. 1 is a top-right perspective view of a first embodiment of a package in its assembled state and open position.
Figure 2:
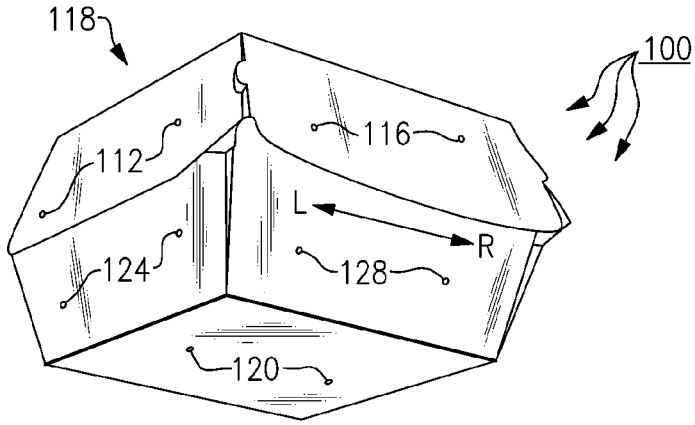
FIG. 2 is a front-left perspective view of the first embodiment package in its assembled state and closed position.

FIGS. 1 to 6 show a first embodiment of a package 100 according to the present invention, the package including: bottom clamshell half portion 102, pivoting portion 104 and top clamshell half portion 106. Bottom clamshell half portion 102 includes: bottom wall 120; bottom back wall 122; bottom left side wall 124; bottom right side wall 126; bottom front wall 128; tabs 132 and fold line 134. Top clamshell half portion 106 includes: top wall 108; top back wall 110; top left side wall 112; top right side wall 114; top front wall 116; and slots 118. The package in its unassembled state (shown in FIG. 4) is assembled into its assembled state (shown in FIGS. 1-3 and 5-6). In its assembled state, pivoting portion 104 is rotatable between a closed position (shown in FIGS. 2, 5 and 6) and an open position (shown in FIGS. 1 and 3). Preferably, package 100 is made from cardboard.

Figure 3:
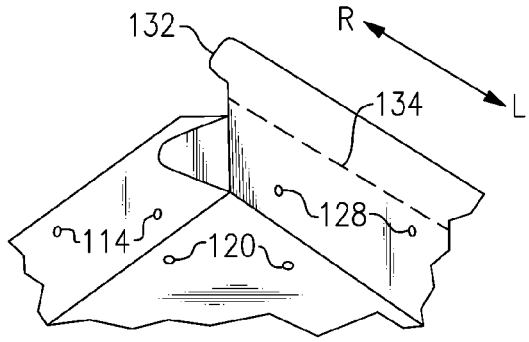
FIG. 3 is a perspective detail view of a portion of the first embodiment package.
Figure 5:
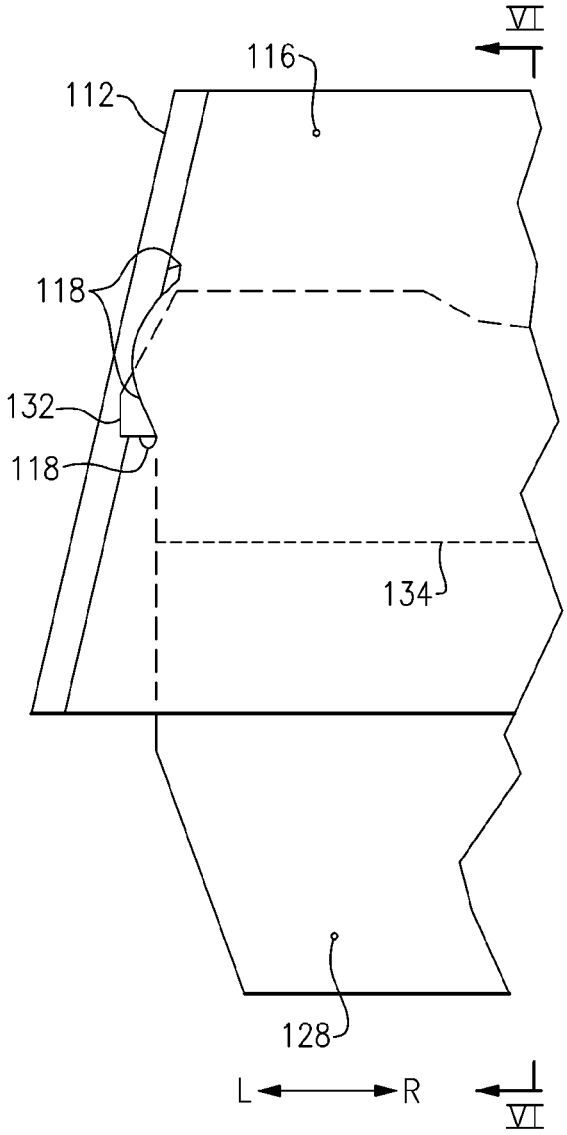
FIG. 5 is an orthographic front view of the left portion of the front side of the first embodiment package in its assembled state and closed position.
Figure 6:
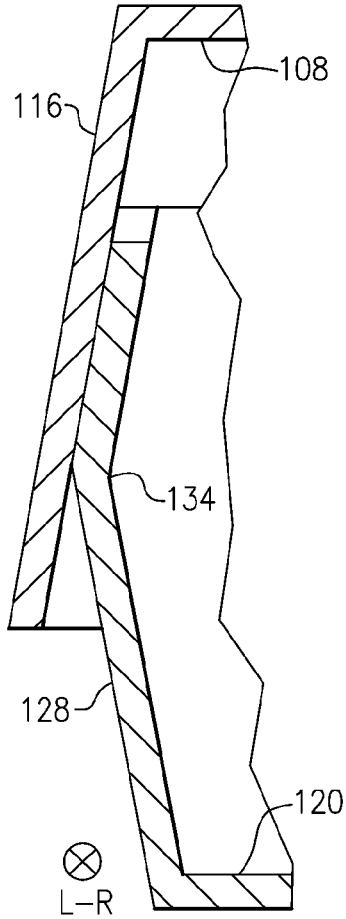
FIG. 6 is a cross-sectional view of the front walls of the first embodiment package in its assembled state and closed position.

As shown in FIG. 5, in the closed position, tabs 132 of fit into respective slots 118. As shown in FIGS. 1 and 3, in the open position, the tabs 132 are released from their respective slots 118. As best shown in FIGS. 5 and 6, perforation 134 helps bottom front wall 128 to lay flat against the top front wall so that the tabs will more reliably engage with their respective slots 118. Package 100 provides a positive side lock that preferably is constructed to allow the package to hold a heavier sandwich than it could with conventional package designs. When an end user presses inwards on the bottom front panel, the tabs 132 release from their respective slots 118 so that the package can be rotated into the open position.

Figure 4:
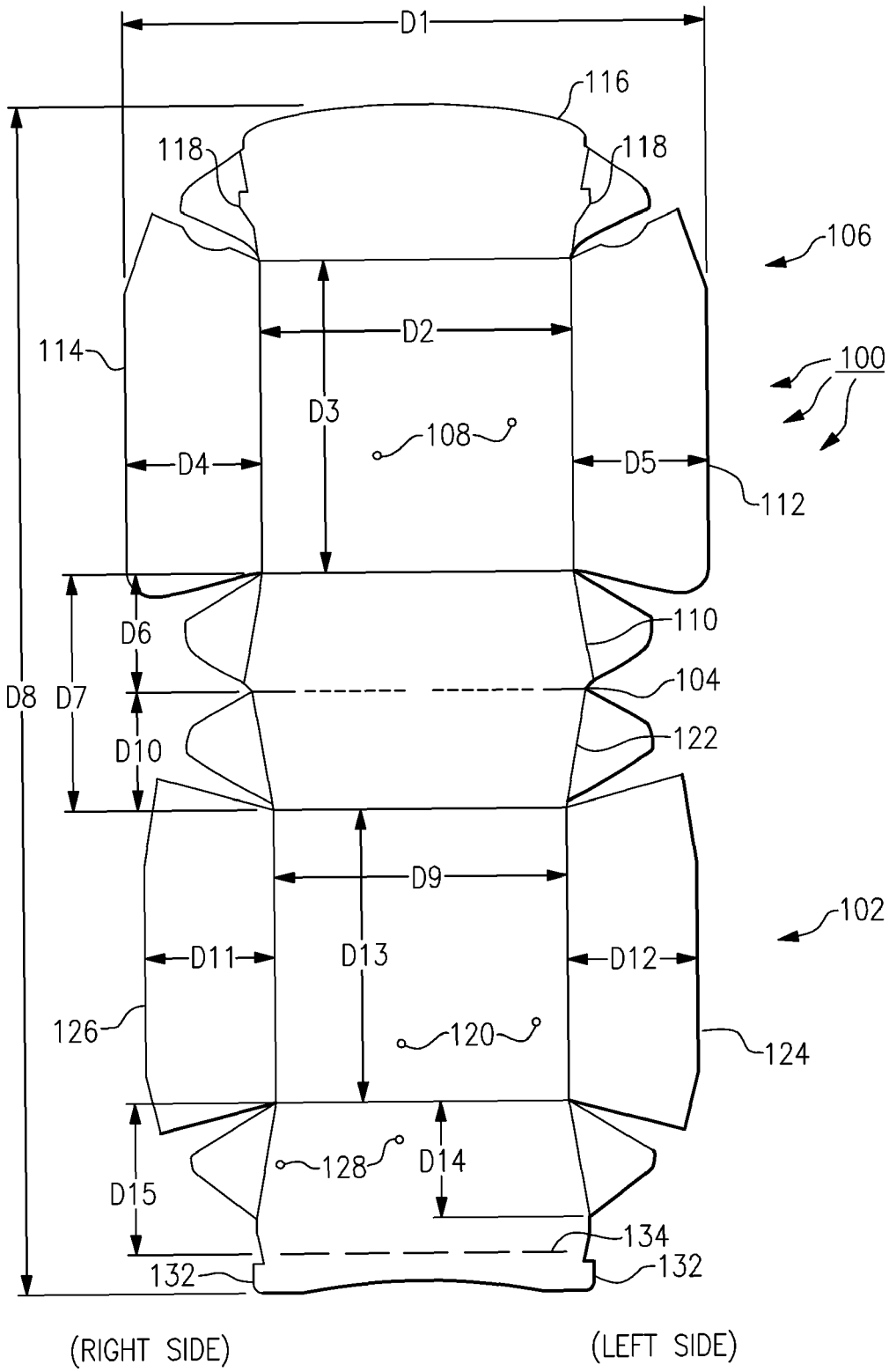
FIG. 4 is an orthographic top view of the first embodiment package in its unassembled state (the surface shown generally becomes the exterior surface when the package is assembled into its assembled state)

Importantly, as shown most clearly shown in FIGS. 3, 4 and 6, tabs 132 extend from bottom front wall 128, along the direction of bottom front wall 128 and generally perpendicular to op left side wall 112 and top right side wall 114. As most clearly shown in FIGS. 3, 5 and 6, bottom front wall 128 includes fold line 134 (which is generally parallel to the axis of rotation of pivoting portion 104) and an upper portion extending above fold line 134. As shown in FIG. 6, the upper portion is bent inwards about the perforation to allow the upper portion to conform to the engaging inner wall of the top clamshell half. Alternatively, perforation could be omitted, and the gentle bend in the bottom front wall could be made without the benefit of a fold line, especially in embodiments utilizing corrugated cardboard, with the direction of the corrugations being oriented left to right to help guide the fold to run left to right. Because the upper portion extends in the upwards direction beyond bottom left side wall 124 and bottom rights side wall 126: (i) the container is better secured in the closed position by the friction engagement between the upper portion of the bottom front wall and the inner surface of the top half of the clamshell; (ii) tabs 132 can be located at a position well up into the top half of the clamshell to improve reliability of the tab and slot closure mechanism; (iii) gentle pressure in the inwards direction applied below the upper portion works to straighten the fold and neatly undo the tab and closure mechanism to open the clamshell without bending the tabs.

Figure 7:
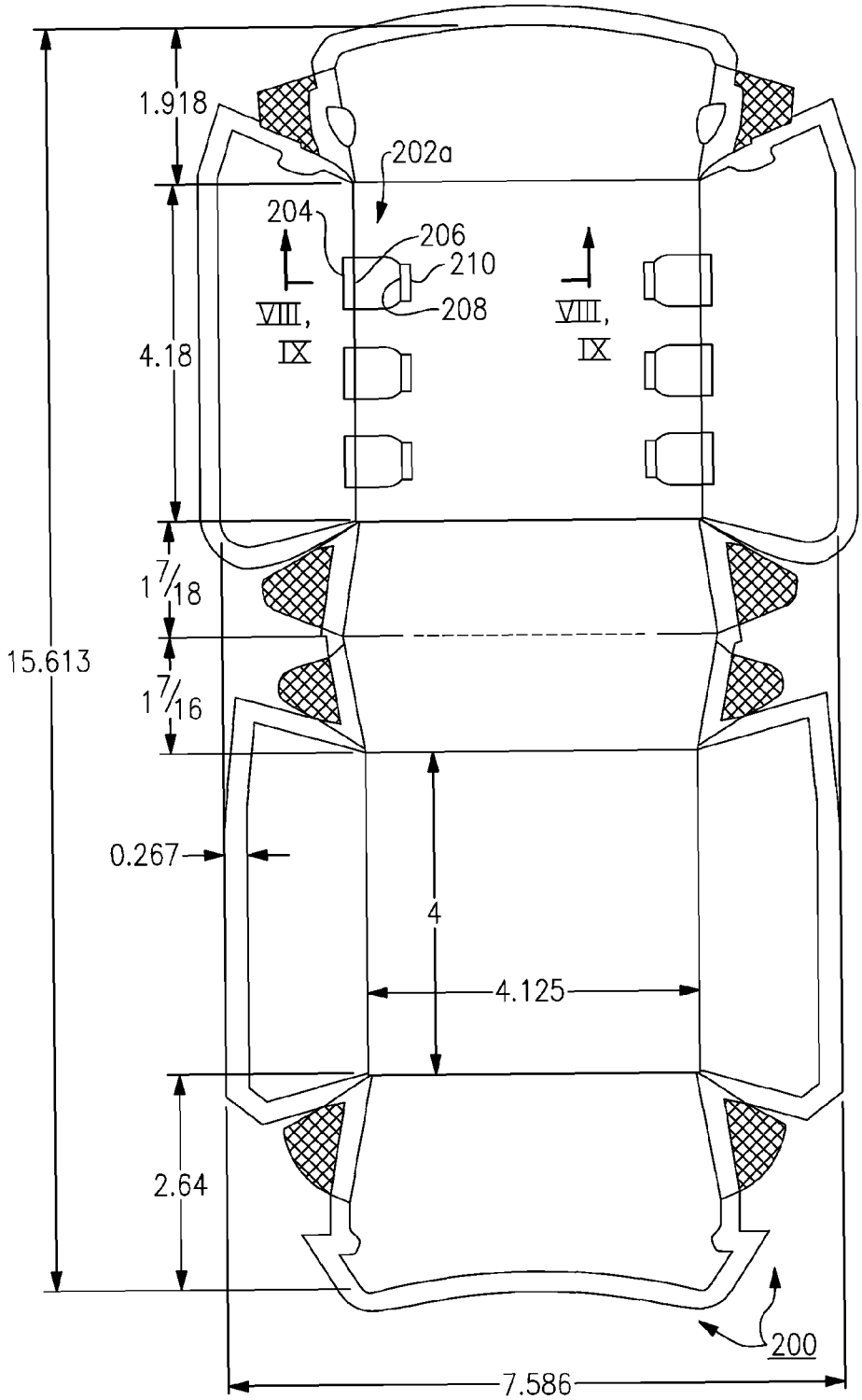
FIG. 7 is an orthographic top view of a second embodiment of a package according to the present invention in its unassembled state (the surface shown generally becomes the exterior surface when the package is assembled into its assembled state)
Figure 8:
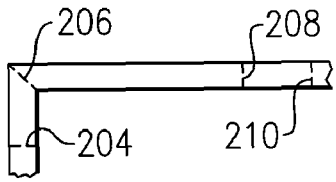
FIG. 8 is a partial cross-sectional view of the second embodiment package.
Figure 9:
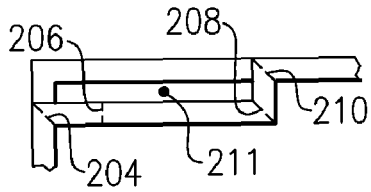
FIG. 9 is a partial cross-sectional view of the second embodiment package.
Figure 10:
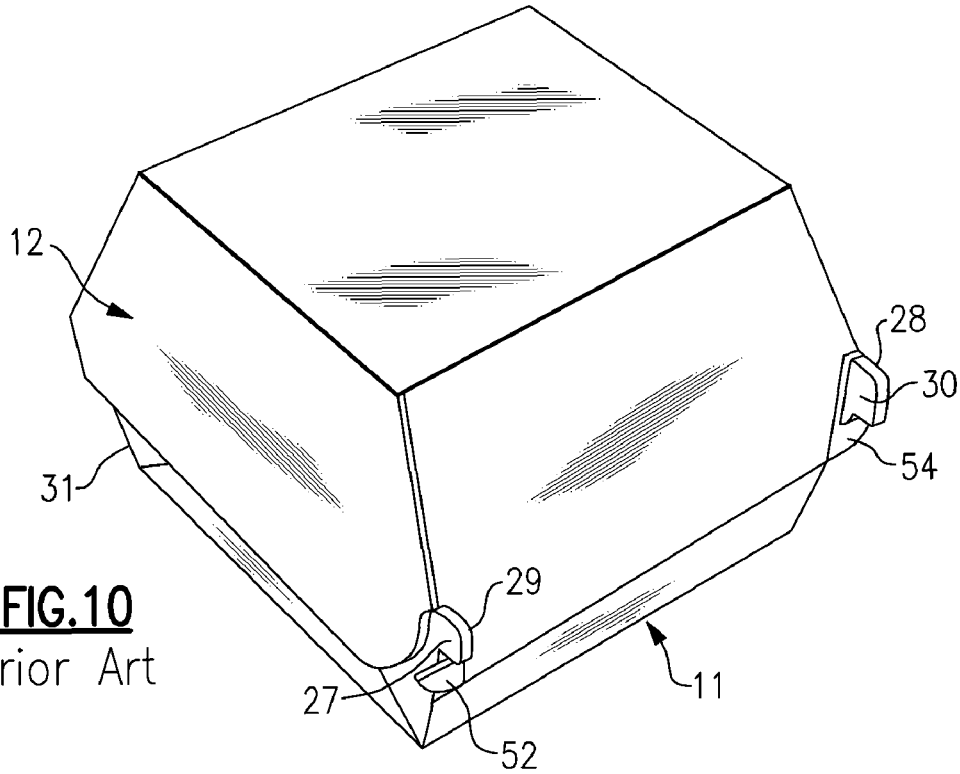
FIG.10 Prior Art
FIG. 10 is a perspective view of a prior art package.

FIGS. 7 to 9 show cardboard package 200 according to the present invention including six punch-in devices 202. FIG. 7 provides some exemplary preferred dimensions in inches. FIG. 7 also shows how the punch-in devices appear when the package is in its unassembled state as flat cardboard. As shown in FIG. 7, punch-in device 202*a* includes first fold line 204, second fold line 206, third fold line 208, and fourth fold line 210. As shown in FIG. 7, each of these fold lines is parallel to a corner of the package and each of the fold lines extend between two generally parallel perforations that are perpendicular to the corner.

FIGS. 8 and 9 show how the punch-in device can be moved from its closed state (FIG. 8) to its open state (FIG. 9) when the package is in its assembled state. More specifically: (i) in the closed state, fold lines 204, 208 and 210 are in the unfolded state, while fold line 206 is in a folded state and forms a part of the corner of the package; and (ii) in the open state, fold lines 204, 208 and 210 are in the folded state, while fold line 206 moves to an unfolded state and moves away from the corner of the package in a direction toward the interior of the package.

DEFINITIONS

The following definitions are provided to facilitate claim interpretation:

Present invention: means at least some embodiments of the present invention; references to various feature(s) of the "present invention" throughout this document do not mean that all claimed embodiments or methods include the referenced feature(s).

First, second, third, etc. ("ordinals"): Unless otherwise noted, ordinals only serve to distinguish or identify (e.g., various members of a group); the mere use of ordinals implies neither a consecutive numerical limit nor a serial limitation.

Mechanically connected: Includes both direct mechanical connections, and indirect mechanical connections made through intermediate components; includes rigid mechanical connections as well as mechanical connection that allows for relative motion between the mechanically connected components; includes, but is not limited, to welded connections, solder connections, connections by fasteners (for example, nails, bolts, screws, nuts, hook-and-loop fasteners, knots, rivets, force fit connections, friction fit connections, connections secured by engagement added by gravitational forces, quick-release connections, pivoting or rotatable connections, slidable mechanical connections, latches and/or magnetic connections).

Cardboard: any material having cellulose as a substantial component, without regard to: (i) presence or absence of corrugation; (ii) thickness; and/or (iii) degree of rigidity or flexibility.

Wall: indicates a structure that is generally flat and planar, but there may be some degree of curvature, discontinuity, gentle angle(s), openings and/or other irregularities so long as a reasonable and ordinary individual would recognize the structure as a single, generally flat and planar wall.

To the extent that the definitions provided above are consistent with ordinary, plain, and accustomed meanings (as generally shown by documents such as dictionaries and/or technical lexicons), the above definitions shall be considered supplemental in nature. To the extent that the definitions provided above are inconsistent with ordinary, plain, and accustomed meanings (as generally shown by documents such as dictionaries and/or technical lexicons), the above definitions shall control. If the definitions provided above are broader than the ordinary, plain, and accustomed meanings in some aspect, then the above definitions shall be considered to broaden the claim accordingly.

To the extent that a patentee may act as its own lexicographer under applicable law, it is hereby further directed that all words appearing in the claims section, except for the above-defined words, shall take on their ordinary, plain, and accustomed meanings (as generally shown by documents such as dictionaries and/or technical lexicons), and shall not be considered to be specially defined in this specification. In the situation where a word or term used in the claims has more than one alternative ordinary, plain and accustomed meaning, the broadest definition that is consistent with technological feasibility and not directly inconsistent with the specification shall control.

Unless otherwise explicitly provided in the claim language, steps in method steps or process claims need only be performed in the same time order as the order the steps are recited in the claim only to the extent that impossibility or extreme feasibility problems dictate that the recited step order (or portion of the recited step order) be used. This broad interpretation with respect to step order is to be used regardless of whether the alternative time ordering(s) of the claimed steps is particularly mentioned or discussed in this document.

What is claimed is:

1. A cardboard package comprising:

a first exterior wall;

a second exterior wall located to meet the first exterior wall at a first corner; and a punch-in device located in the vicinity of the first corner, the punch-in device comprising:

a first perforation extending across the first corner and at an angle to the first corner, a second perforation extending across the first corner and at an angle to the first corner, a first fold line generally parallel to the first corner and extending at least from the first perforation to the second perforation, a second fold line generally parallel to the first corner and extending at least from the first perforation to the second perforation, a third fold line generally parallel to the first corner and extending at least from the first perforation to the second perforation, and a fourth fold line generally parallel to the first corner and extending at least from the first perforation to the second perforation;

wherein:

the cardboard package is moveable between an open position and a closed position;

when the cardboard package is in the closed position the first exterior wall is exposed to the outside at least in the vicinity of the first corner; and when the cardboard package is in the closed position the second exterior wall is exposed to the outside at least in the vicinity of the first corner.

* * * * *